US006529115B2

(12) United States Patent
Szwarc et al.

(10) Patent No.: US 6,529,115 B2
(45) Date of Patent: Mar. 4, 2003

(54) SURFACE MOUNTED RESISTOR

(75) Inventors: Joseph Szwarc, Ramat Gan (IL); Ilya Aronson, Kfar-Sava (IL)

(73) Assignee: Vishay Israel Ltd., Holon (IL)

( * ) Notice: Subject to any disclaimer, the term of this patent is extended or adjusted under 35 U.S.C. 154(b) by 0 days.

(21) Appl. No.: 09/810,207

(22) Filed: Mar. 16, 2001

(65) Prior Publication Data

US 2002/0130759 A1 Sep. 19, 2002

(51) Int. Cl.[7] ..... H01C 1/012
(52) U.S. Cl. ..... 338/309; 338/307
(58) Field of Search ..... 338/308, 309, 338/307, 22 R, 25, 322, 329; 257/735, 737, 738

(56) References Cited

U.S. PATENT DOCUMENTS

| | | | | |
|---|---|---|---|---|
| 3,405,381 A | | 10/1968 | Zandman et al. | |
| 3,517,436 A | | 6/1970 | Zandman et al. | |
| 3,718,883 A | | 2/1973 | Berman et al. | |
| 3,955,068 A | * | 5/1976 | Shaheen | 219/549 |
| 3,996,551 A | * | 12/1976 | Croson | 339/309 |
| 4,136,656 A | | 1/1979 | Sokolov et al. | |
| 4,172,249 A | | 10/1979 | Szwarc | |
| 4,286,249 A | | 8/1981 | Lewis et al. | |
| 4,677,413 A | * | 6/1987 | Zandman et al. | 338/7 |
| 5,641,990 A | * | 6/1997 | Chiu | 257/737 |
| 5,684,677 A | * | 11/1997 | Uchida et al. | 361/770 |
| 5,815,065 A | * | 9/1998 | Hanamura | 338/309 |
| 5,901,041 A | * | 5/1999 | Davies et al. | 361/704 |
| 5,903,052 A | * | 5/1999 | Chen et al. | 257/706 |
| 5,928,003 A | * | 7/1999 | Kajinuma | 439/74 |
| 6,114,287 A | * | 11/2000 | Komeda | 338/195 |

FOREIGN PATENT DOCUMENTS

| | | |
|---|---|---|
| JP | 08064401 | 8/1996 |
| JP | 2001035882 | 9/2001 |

OTHER PUBLICATIONS

Zero TCR Foil Resistor: Ten–Fold Improvem,ent in Termperature Coefficient. Carts–Europe 2000: 14$^{th}$ European Passive Components Symposium, Oct. 16, 2000. F. Zandman, P.–R. Simon, J. Szwarc, Resistor Theory and Technology, Scietch Publishing, Inc. (2000).

* cited by examiner

*Primary Examiner*—Elvin Enad
*Assistant Examiner*—Kyung S. Lee
(74) *Attorney, Agent, or Firm*—McKee, Voorhees & Sease, P.L.C.

(57) ABSTRACT

A precision surface mounted foil resistor has a substrate having top and bottom planar surfaces. A resistance foil is secured to the bottom surface of the substrate and extends over the bottom. A bending protector plate of non-conductive material is superimposed over the resistance foil. A solder material is located at two areas of the foil to provide electrical contact with the PCB. The bending protector element is thicker than the solder contact areas and is provided between the solder material.

14 Claims, 4 Drawing Sheets

SURFACE MOUNTED RESISTOR

FIELD OF THE INVENTION

This invention relates to precision surface mounted resistors of the general type shown in U.S. Pat. Nos. 3,405,381; 3,517,436; 3,718,883; 4,136,656; 4,172,249 and 4,286,249.

BACKGROUND OF THE INVENTION

Among the various technologies used to produce resistive electronic components, the foil resistor technology is known to produce very tight resistance tolerances and which have the lowest temperature coefficient of resistance (TCR). Such devices have been made since 1963, as described in detail by the above referenced patents, by bonding of resistive foil to a rigid substrate to form resistive chips. The foil is photo-etched and adjusted to reach the desired ohmic value and tolerance. Copper or gold wire leads or ribbons are attached, mechanically and electrically, to the chip and the assembly is encapsulated in a plastic case or molding in a coating.

With the advent of the surface mounting technology (SMT), molded electronic devices were designed with flat leads protruding from the plastic and formed into "gull wings", "J wings" or other forms to facilitate soldering to pads on a printed circuit board (PCB). This technology partially replaced the "Through Hole Technology". These assemblies are substantially larger than the chip itself and are expensive to produce compared to production cost of the chip itself.

A reduction in size has been achieved by designing SMT chips with a "wrap around metallization" not necessitating any wiring or molding. These chips have the resistive foil attached to one side of the substrate and are electrically connected to metallization on the other side of the substrate and to it's lateral surfaces, (see FIG. 1).

It is known in the electronic art, mainly in semiconductors, to produce devices called flip chips or bump devices attached through solder balls to the PCB. However, such devices were never used for Ni—Cr alloy precision foil precision resistors. Due to high precision and stability of foil resistors the strain sensitivity becomes a very important factor.

The resistance changes and the resistor are no longer within tolerance when the chip is soldered to the PCB because of strains imposed on the chip during soldering. These changes are in the order of magnitude of $20\times10^{-6}$ to $200\times10^{-6}$ cm/cm strain, resulting in resistance changes of about 40 to 400 ppm (parts per million) ohm per ohm. Since most of foil resistors are used with a tolerance of 100 to 1000 ppm (ohm per ohm), this kind of change is not acceptable. Furthermore, in case of a ratio of two resistance values serving for voltage division, the error is further aggravated.

This strain situation occurs mostly due to bending of the chip when the user is mounting the resistor chip onto the PCB. The forces during this mounting and the forces due to further protection and soldering to the PCB produce strains, spoils the initial tolerance achieved during the production of resistors.

Furthermore, after soldering the chip to the PCB an air gap exists between the chip and the PCB impeding heat transfer from the chip to the PCB. Accordingly, the heat transfer is done mainly through the pads. Power handling capability is greatly improved if this heat transfer is improved.

Therefore, the principal object of this invention is to provide a chip resistor with improved characteristics of accuracy, stability, and power handling, and which is less costly to produce.

A further object of this invention is to provide a chip resistor wherein the chip will essentially not be sensitive to bending during and after soldering it to the PCB and the chip being in intimate contact with the PCB (no air gap) will provide a good heat transfer, hence a better power handling of the chip.

These and other objects will be apparent to those skilled in the art.

SUMMARY OF THE INVENTION

This invention relates to a resistive Ni—Cr foil chip which is directly attached by soldering to the PCB. It occupies essentially only the surface and thickness of the chip itself and enables improvement in accuracy, stability, heat transfer, cost and size when compared to "wrap around" or molded designs.

The chip includes solder balls or solder tabs and a bending protector plate which is applied to the surface of the chip in a way that after soldering to the PCB the chip is in intimate contact with the PCB, the resistive foil being on the surface close to the PCB. This minimizes the strain due to bending during assembly and soldering onto a PCB. The bending protector can be cemented to the PCB in order to reduce the thermal resistance of the interface. Manufacturing costs are reduced and reduction in space and thickness is achieved. In each case the foil is cemented to the substrate by a cement (shown in FIGS. 1*b*, 2*a* and 2*b*), and protected by a polymer shown only in FIGS. 1*b*, 2*a* and 2*b*.

DESCRIPTION OF THE EMBODIMENTS OF THIS INVENTION

Figure 1A:
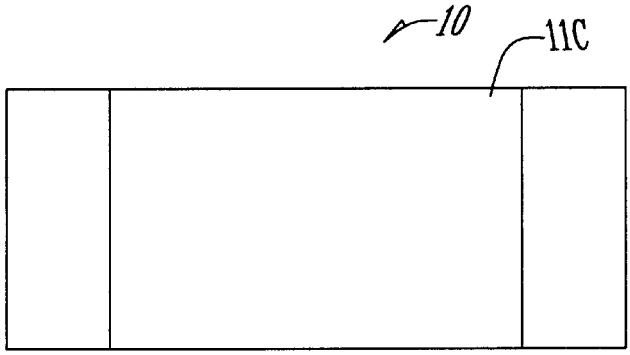
Fig. 1a (PRIOR ART)
FIG. 1*a* is a plan view of a prior art SMD resistor chip with wrap around metallization.
Figure 1B:
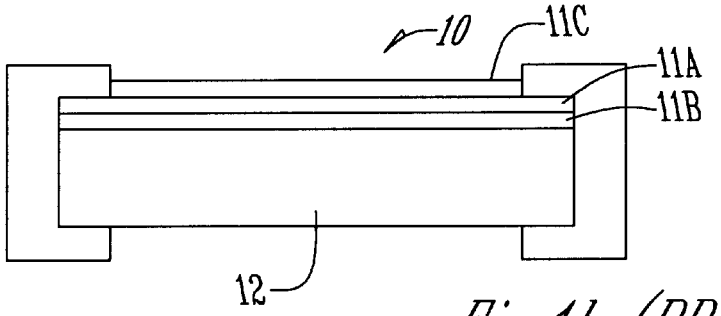
Fig. 1b (PRIOR ART)
FIG. 1*b* is a side elevation of the device of FIG. 1*a;*
Figure 1C:
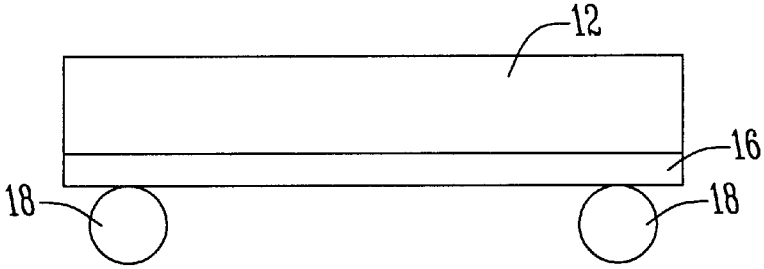
Fig. 1c (PRIOR ART)
FIG. 1*c* is a prior art device without a bending protector and hence very sensitive to bending strains and not good for heat transfer.

A prior art chip 10 is shown in FIGS. 1*a*, 1*b* and 1*c*. Chip 10 has a "wrap around metallization" feature including a resistive foil 11A attached to one side of substrate by cement 11B and electrically connected to a metallization on the side of the foil, the opposite side of the substrate and the lateral sides of the substrate. Furthermore, the foil is protected by a polymer 11C. This construction is expensive to produce and does not provide a good heat transfer.

Figure 2A:
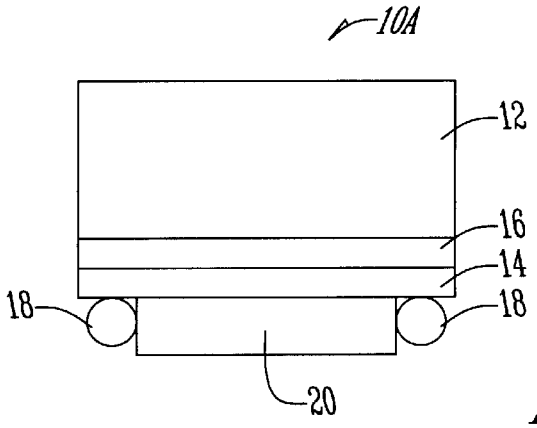
FIG. 2*a* is an elevational view of the device of this invention before mounting on a PCB.
Figure 2B:
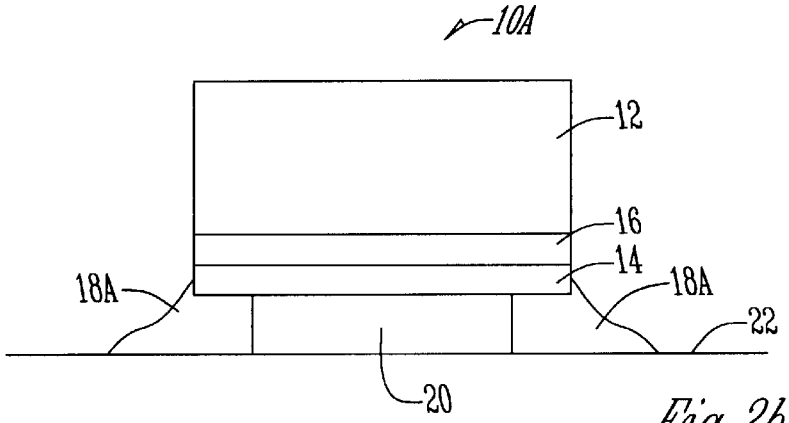
FIG. 2*b* is a side elevational view of the device of FIG. 2*a* after soldering to the PCB.

The preferred construction of this invention is illustrated in FIGS. 2*a* and 2*b*. The chip 10A includes a substrate 12. A layer of resistive foil 14 is secured to the bottom surface of substrate 12 by a layer of cement 16. In FIG. 2*a*, solder balls 18 are located adjacent the ends of the resistive foil on opposite ends of a bending protector 20. The bending protector must have a thickness bigger than the solder pads (balls) to assure good contact with the PCB after soldering. FIG. 2*b* shows the next step in the process where the solder balls 18 are melted to form 18A to move into intimate contact with PCB surface 22 and provide an intimate contact between the bending protector 20 and the PCB. Solder paste is on the PCB surface 22 opposite to balls 18 to facilitate the mounting of the chip 10A on the surface 22. This contact can be enhanced by applying a thin layer of cement between the bending protector and the PCB and curing it.

Figure 3A:
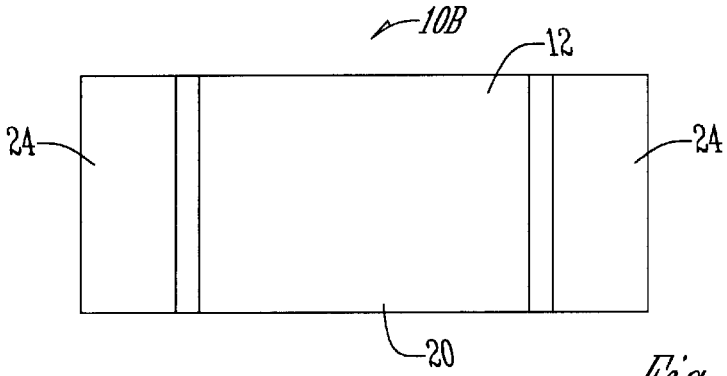
FIG. 3*a* is a bottom plan view of a first alternative embodiment of the invention.
Figure 3B:
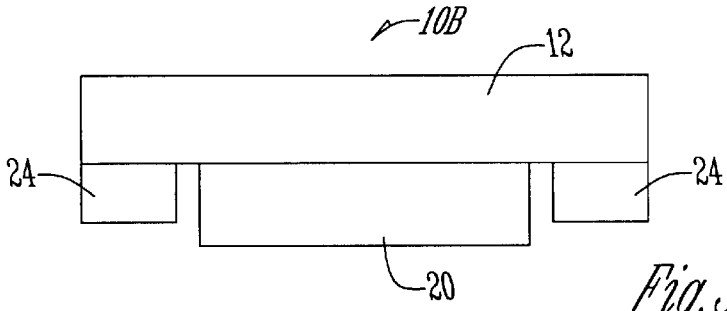
FIG. 3*b* is a side elevational view of the device of FIG. 3*a;*

A first alternative embodiment of the invention is shown in FIGS. 3*a* and 3*b*. Chip 10B has a substrate 12 and bending protector 20, but with rectangular solder pads 24 instead of the solder balls 18 in FIG. 2*a*. FIGS. 3*a* and 3*b* are understood to also have the foil layer 11A and cement and polymer layers of 11B and 11C of FIG. 1B, although they are not specifically shown. When the solder pads 24 are melted together with the solder paste of the PCB, they will encompass the member 20 in the same way as reflected by the solder 18A in FIG. 2*b*. The foregoing assumptions in regard to the foil layer 11A and cement and polymer layers 11C and 11B will also apply to FIGS. 4*a*, 4*b*, 5*a*, 5*b*, 6*a*, 6*c* and 7–10.

Figure 4A:
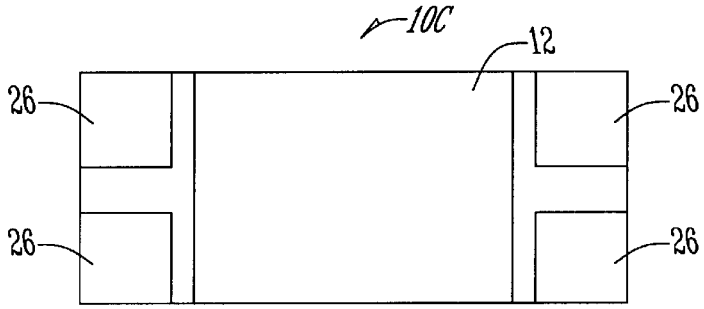
FIG. 4*a* is a bottom plan view of a second alternative form of the invention with four contacts.
Figure 4B:
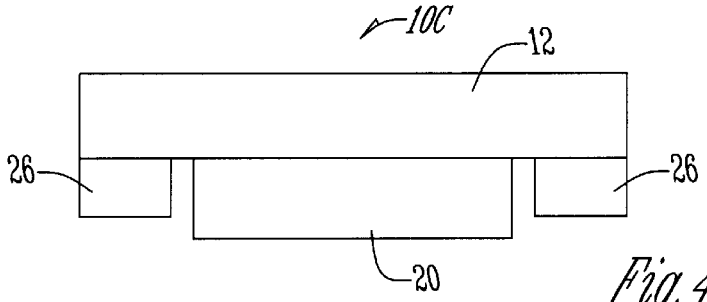
FIG. 4*b* is a side elevational view of the device of FIG. 4*a;*

The chip 10C in FIGS. 4*a* and 4*b* is a second alternative embodiment of the invention. Chip 10C is the same as chip 10B of FIGS. 3*a* and 3*b* except that four rectangular solder contacts 26 are used for current sensing.

Figure 5A:
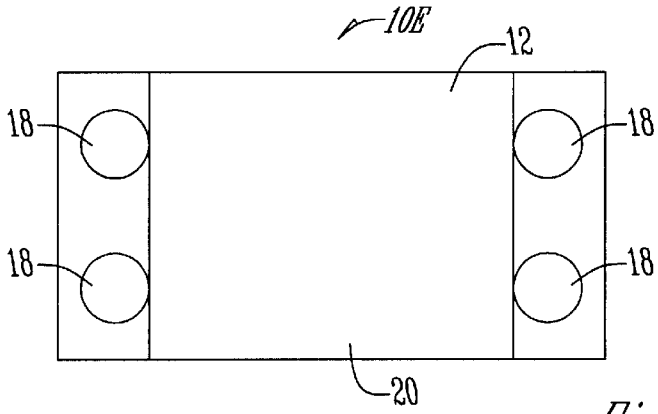
FIG. 5*a* is a bottom plan view of a further alternative form of the invention using four contact balls.
Figure 5B:
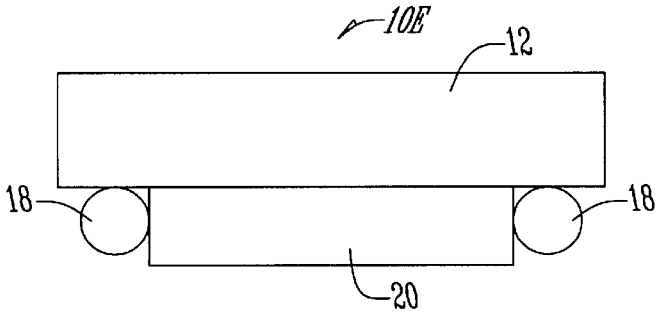
FIG. 5*b* is a side elevational view of the device of FIG. 5*a;*

A third alternate invention is a chip 10E in FIGS. 5*a* and 5*b*. It is similar to the arrangement in FIG. 2*a* except in FIG. 2*a*, only a single solder ball is used on each side of bending protector 20; while in FIGS. 5*a* and 5*b*, four balls 18 are used.

Figure 6:
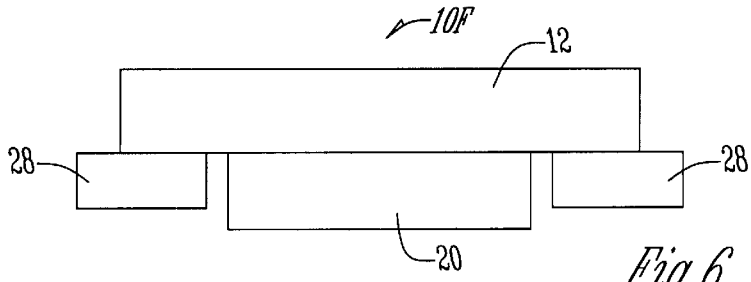
FIGS. 6–10 are side elevational views of alternative forms of the invention immediately before mounting on a PCB. The dimensions of all the drawings are not to scale. Note that in each case the bending protector is thicker than the contact balls or pads.

A fourth alternate form of the invention is shown by the chip 10F in FIG. 6 which shows rectangular contacts 28 which extend outside the bottom surface of the chip to provide for easy visual inspection.

Figure 7:
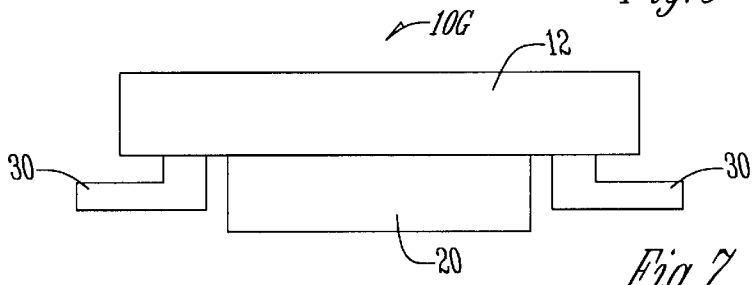

A fifth alternative form of the invention is shown by chip 10G in FIG. 7 which uses flexible L-shaped contacts 30 to avoid lateral stress to temperature changes.

Figure 8:
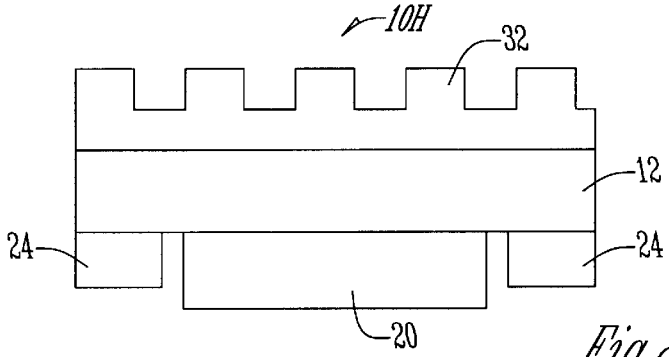

A sixth alternate form of the invention is shown in FIG. 8 by chip 10H which is similar to chip 10B in FIG. 3*b* except that chip 10H has metal heat sink 32 secured to the upper surface of substrate 12.

Figure 9:
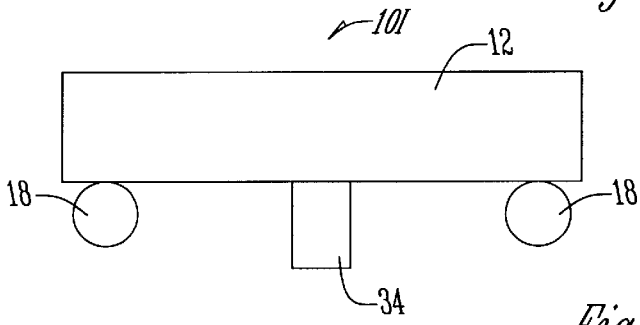

A seventh alternate form of the invention is shown in FIG. 9 by chip 10I which is similar to chips 10D and 10E of FIGS. 5*b* and 6*b*, respectively except that a narrow bending stopper 34 is centrally positioned on the bottom of substrate 12 in place of the bending protector 20 on chips 10D and 10E.

Figure 10:
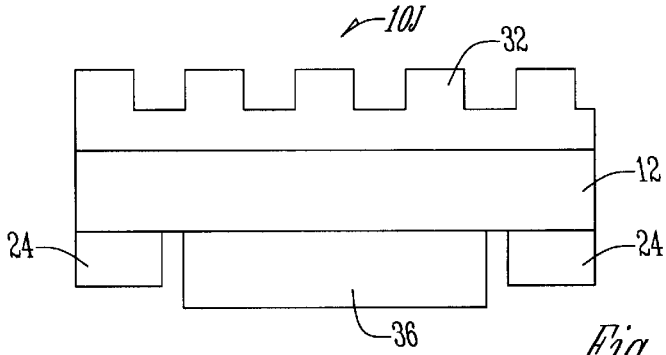

An eighth alternate form of the invention is shown in FIG. 10 by chip 10J. Chip 10J is similar to chip 10H of FIG. 9 except that metal bending protector 36 is used on chip 10J in place of the bending protector 20 on chip 10H.

The construction of the chip 10A in FIGS. 2*a* and 2*b* is as follows:

1. The chip consists of a photo-etched Ni—Cr alloy foil cemented to one side of a rigid substrate and the foil is protected by a layer of polymer except in pad areas of electrical contact.

2. Two or more solder balls, bumps or rectangles are attached to pads (not shown) on the foil. The pads can be plated for better adhesion between foil and solder.

3. The foil is covered by a layer of plastic serving as a bending protector to prevent bending of chip during mounting on the PCB. Said bending protector being thicker than the solder contacts on the chip.

4. The chip is mounted to the PCB with the foil facing the PCB.

Material used for the chip is as follows:

1. Foil—Nickel-Chrome alloy with traces of other metals, thickness 1 to 25 micrometers. Pads are gold plated or otherwise prepared for receiving solder (etching or abrading of pad's surface, Nickel, Cooper or Gold plating; sputtering or evaporating metal on pads to improve adhesion of solder).

2. Substrate—ceramic, alumina, glass, sapphire, metal with insulation.

3. PCB—epoxy fiber glass, ceramic.

4. Bending protector: Thickness: flush with the PCB surface when chip is mounted, (see FIG. 2*b*) and said bending protector being thicker than the solder pads or balls prior to mounting. Protector 20 is made of plastic (epoxy, silicone or other), ceramic, metal. (If metal is used, contact with the solder should be avoided, but excellent for heat transfer, see FIG. 10).

For better heat dissipation, the chip surface not facing the PCB has a metal heat sink 32 attached to it.

All of the manufacturing is done in a wafer (or plate) form where many chips are produced simultaneously (bonding of foil to substrate, photo-etching and trimming to final value of resistive pattern, plating of pads, application of bending protector, cutting of wafer into separate chips). This process is inexpensive per device and the cut wafer is ready for pick and place assembly of chips onto a PCB, without manual handling of individual chips or for packaging in reels or otherwise.

Among the advantages of this construction are:

1. Smaller, thinner devices of the same size as the basic chip itself.

2. No molding, no lead-frame, no gold wire bonding (or ribbon welding) is required which provides a less expensive device by decreasing both materials and labor cost.

3. The device is not handled individually because all processing is done on a wafer (plate); bonding of foil to a large substrate, photo-etching of resistive pattern, trimming to value, plating of pads, application of bending protector, cutting of wafer into separate chips—while the substrate is attached to a thin plastic holder like a silicone wafer before pick and place operations. The finished plate in cut form is ready either for pick and place assembly onto a PCB or to a packaging system.

From the foregoing it is seen that this invention will provide a very thin inexpensive chip that can be made essentially without being individually touched by human hands, which is resistant to bending and the problems associated therewith and which provides an excellent heat transfer when soldered to a PCB.

What is claimed is:

1. A precision surface mounted foil resistor for mounting to a PCB surface, comprising, a rigid substrate having top and bottom planar surfaces, and opposite ends, a resistance foil secured to the bottom planar surface of the substrate and extending over the bottom planar surface, a solder material at two areas of the resistance foil and in contact with the resistive foil for surface mounting to the PCB surface, a bending protector plate element of non-conductive material superimposed over the resistance foil without covering the solder material for intimately contacting the PCB surface; the bending protector having a thickness exceeding the thickness of the solder material on the resistance foil.

2. The resistor of claim 1 wherein the solder material is one solder ball at two areas of the resistance foil, with the remainder of the foil being protected with a polymer.

3. The resistor of claim 1 wherein the solder material is two spaced solder balls at each end of the bending protector plate.

4. The resistor of claim 1 wherein the solder material is one rectangular-shaped solder member at two areas of the foil element.

5. The resistor of claim 1 wherein the solder material is two spaced rectangular-shaped solder members at each end of the plate element.

6. The resistor of claim 5 wherein an exterior edge of each solder member extends outwardly from the ends of the substrate.

7. The resistor of claim 1 wherein the solder material is comprised of two L-shaped configurations that extend downwardly and thence outwardly from the bottom of the substrate at each end of the plate element.

8. The resistor of claim 1 wherein a heat sink element is secured to the top of the substrate.

9. The resistor of claim 1 wherein the bending protector plate is comprised of plastic.

10. The resistor of claim 1 wherein the bending resistance plate is comprised of one of epoxy, ceramic, glass or metal.

11. The resistor of claim 1 wherein the resistance foil is comprised of nickel-chrome alloy with a thickness of 1–25 micrometers.

12. The resistor of claim 1 wherein the substrate material is one of ceramic, alumina, insulated metal, glass or sapphire.

13. A precision surface mounted foil resistor for surface mounting to PCB surface, comprising, a rigid substrate having top and bottom planar surfaces, and opposite ends, a resistive foil secured to the bottom surface of the substrate and extending over the bottom surface, a bending protector element of non-conductive material extending downwardly from a center portion of the bottom of the substrate for intimately contacting the PCB surface, and a solder material for surface mounting to the PCB surface on opposite ends of the protector element and in contact with the resistive foil;

said solder material having a thickness less than the thickness of the bending protector.

14. A precision surface mounted foil resistor for surface mounting to a PCB surface, comprising, a rigid substrate having top and bottom planar surfaces, and opposite ends, a resistance foil secured to the bottom surface of the substrate and extending over the bottom, a metal bending protector extending downwardly from a center portion of the bottom of the substrate and for intimately contacting the PCB surface, and a solder material for surface mounting to the PCB surface at opposite ends of the metal bending protector and in contact with the resistive foil whereby the bending metal protector is thicker than the solder material and is free from contact therewith.

* * * * *